US009662553B2

(12) United States Patent
Cheng

(10) Patent No.: US 9,662,553 B2
(45) Date of Patent: May 30, 2017

(54) BASE FOR GOLF BAG

(71) Applicant: Kai-Lun Cheng, Miaoli County (TW)

(72) Inventor: Kai-Lun Cheng, Miaoli County (TW)

( * ) Notice: Subject to any disclaimer, the term of this patent is extended or adjusted under 35 U.S.C. 154(b) by 200 days.

(21) Appl. No.: 14/713,015

(22) Filed: May 15, 2015

(65) Prior Publication Data

US 2015/0360102 A1 Dec. 17, 2015

(30) Foreign Application Priority Data

Jun. 13, 2014 (TW) ..... 103210483 U

(51) Int. Cl.
*A63B 55/00* (2015.01)
*A63B 55/50* (2015.01)

(52) U.S. Cl.
CPC ..... *A63B 55/50* (2015.10); *A63B 2210/50* (2013.01)

(58) Field of Classification Search
CPC ..... A63B 55/50; A63B 2210/50
See application file for complete search history.

(56) References Cited

U.S. PATENT DOCUMENTS

| | | | | |
|---|---|---|---|---|
| 6,935,496 | B2 * | 8/2005 | Chang | A63B 55/50 206/315.3 |
| 8,141,705 | B2 | 3/2012 | Aubrey et al. | |
| 9,314,679 | B2 * | 4/2016 | Engel | A63B 55/00 |
| 2006/0108243 | A1 * | 5/2006 | Tan | A63B 55/00 206/315.6 |
| 2014/0034527 | A1 * | 2/2014 | Anderson | A63B 55/00 206/315.6 |
| 2015/0076019 | A1 * | 3/2015 | Cheng | A63B 55/00 206/315.6 |

* cited by examiner

*Primary Examiner* — Tri Mai
(74) *Attorney, Agent, or Firm* — Jackson IPG PLLC; Demian K. Jackson

(57) ABSTRACT

The present invention provides a base for golf bag, comprising a base plate, an upper frame and a number of coupling pieces. The base plate is in the shape of a shell with an upward opening. Its periphery is configured with a number of inserting plates. A number of through portions are configured on the ring body at positions corresponding to the inserting plates. The upper frame is coupled on the base plate in a detachable form, with its periphery configured with a number of inserting slots with downward openings and through-holes connecting with the inserting slots. The inserting plates are to be correspondingly inserted into the inserting slots, so that the base plate and the upper frame can be combined together. The through-holes are corresponding to the through portions. The coupling pieces can be inserted into the through-holes and through portions in a detachable form.

10 Claims, 4 Drawing Sheets

BASE FOR GOLF BAG

BACKGROUND OF INVENTION

1. Field of the Invention

The present invention relates generally to a golf bag, and more particularly to a base for golf bag which features easy assembly, good flexibility and light weight.

2. Description of Related Art

The structure of a conventional golf bag to hold golf clubs generally includes such components as a head frame, a base, a plurality of rods connecting the head frame and the base, a bag body covering the outside of the head frame and base, and a support frame connecting the head frame and the base so that the golf bag can stand on the ground. As the base is to be placed on the ground for insertion of the support rod and connection with the bottom of the bag body, it must have sufficient strength and support. Therefore, currently known golf bag bases are mostly made of plastic materials through integral formation (to minimize the weight of the golf bag). However, the conventional golf bags are normally assembled in the factory and transported to the dealers or distributors for sale. When the base gets worn out after a long time of use, or when the user has a need to change the shape of the golf bag, it is impossible for the consumers to choose components as they wish for DIY assembly. And a ready-assembled golf bag takes up a large space and causes high cost of packaging and transportation.

To solve the above-stated problems, some manufacturers have developed modular head frames or bases. An example is U.S. Pat. No. 8,141,705, wherein the head frame is a modular structure, combined by inserting the plurality of inserting plates configured on the separating piece into the inserting holes configured on the frame body, while the base is not a modular structure. Although the head frame disclosed in this U.S. Patent is a modular structure, it is in fact a one-time combined structure, i.e., the separating piece and the frame body of the head frame are very hard to be disassembled after combination, or, they cannot be rigidly combined after disassembly. The reason is, both the separating piece and the frame body are made of plastic materials, and when the inserting plates of the separating piece are inserted into the inserting holes of the frame body, the tip ends of the inserting plates are normally worn out a bit. Moreover, under the influence of long-time exposure to the varying environmental temperatures, the frame bogy, the separating piece and the inserting plates are all subject to slight deformation, and when the separating piece is disassembled from the frame body, it is very difficult to install it again onto the frame body.

A one-time combined head frame structure cannot solve the above-stated problems of impossible DIY assembly by the consumers and high cost of packaging and transportation due to the large space occupied. Therefore, modular head frames and bases with replaceable components are the future direction of development for manufactures. However, up till now, there are no such bases that feature convenient replacement and rigid combination at the same time.

SUMMARY OF THE INVENTION

The main objective of the present invention is to provide a base for golf bag that can solve the above-stated shortcomings. It is of a structure that can be assembled and disassembled, featuring easy installation, flexible usage, simplified structure, light weight, low production cost, and lowered transportation cost. Hence, it indeed has a high practical value.

Thus, to accomplish the above objective, the present invention provides a base frame for golf bag, comprising a base plate, in the shape of a shell having an upward opening, including a baseboard and a ring body connecting to the periphery of the baseboard, wherein the ring body is configured with a number of inserting plates, and a number of through portions are configured on the ring body at positions corresponding to the inserting plates; an upper frame, complementary to the sectional shape of the ring body, coupled on the ring body in a detachable form, with its periphery configured with a number of inserting slots with downward openings and a number of through-holes. The inserting plates are to be correspondingly inserted into the inserting slots, so that the base plate and the upper frame can be combined together. The through-holes are corresponding to the through portions; a plurality of coupling pieces, inserted into the through-holes and through portions in a detachable form.

BRIEF DESCRIPTION OF THE DRAWINGS

The present invention will be more readily understood with reference to the accompanying drawings.

DETAILED DESCRIPTION OF THE INVENTION

Figure 1:
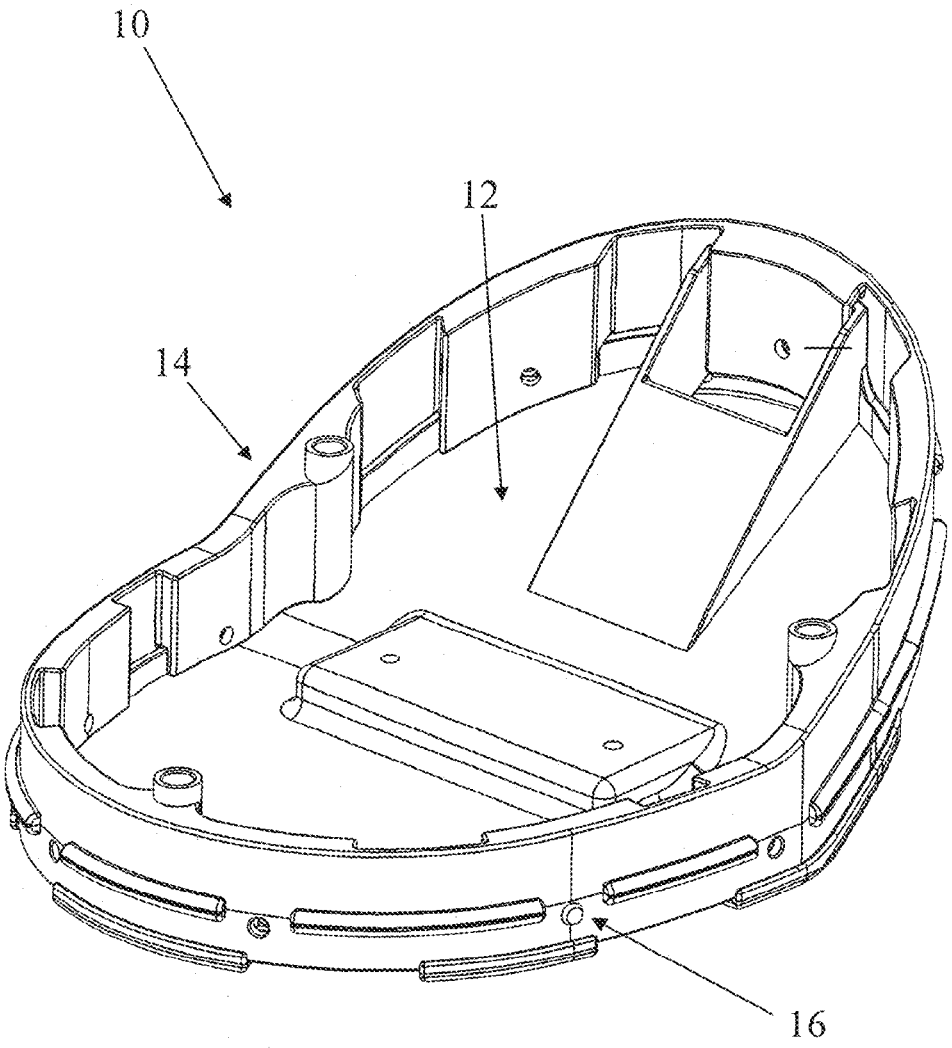
FIG. 1 is a perspective view of a preferred embodiment of the present invention.
Figure 2:
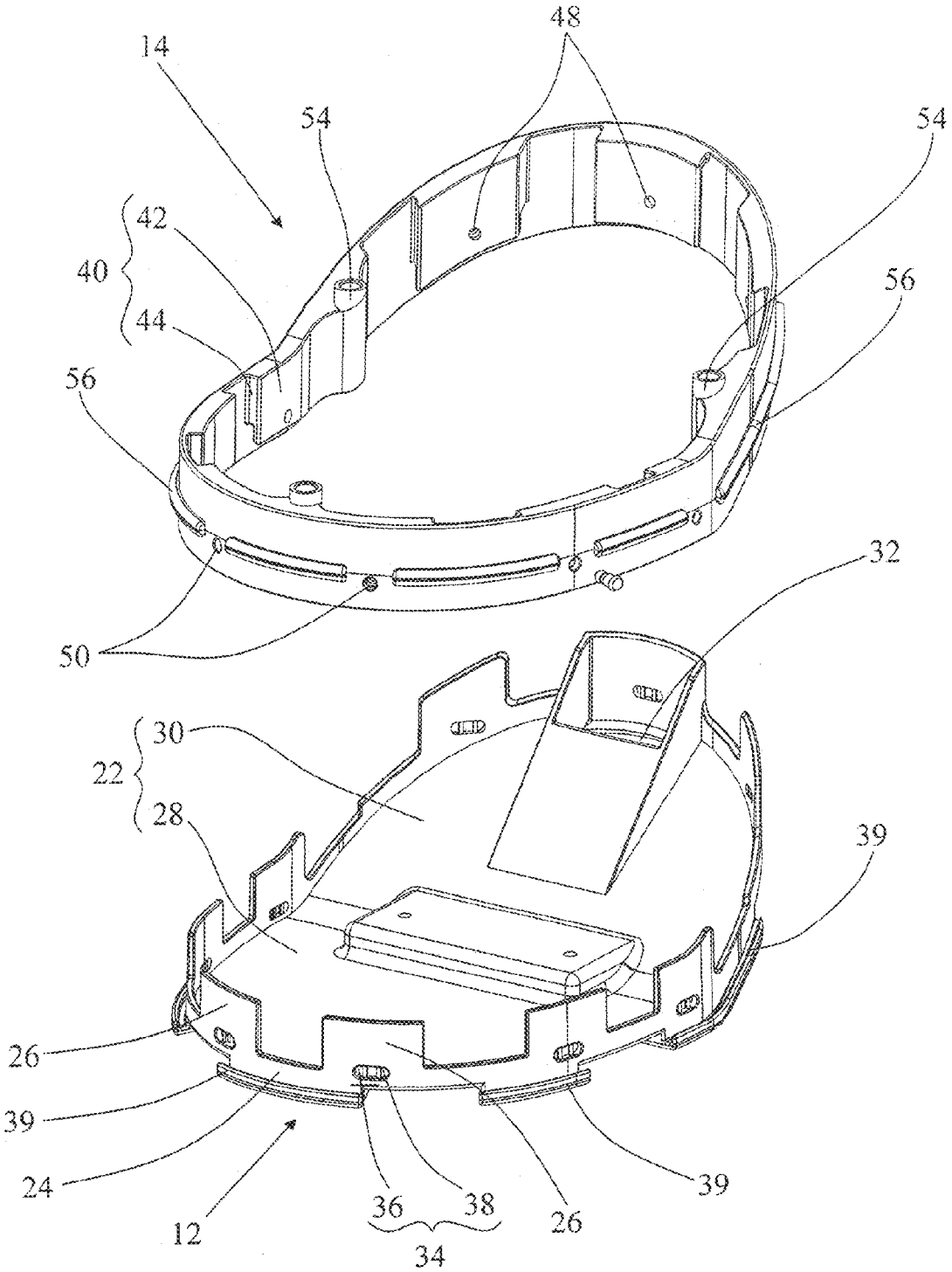
FIG. 2 is an exploded perspective view of a preferred embodiment of the present invention.
Figure 3:
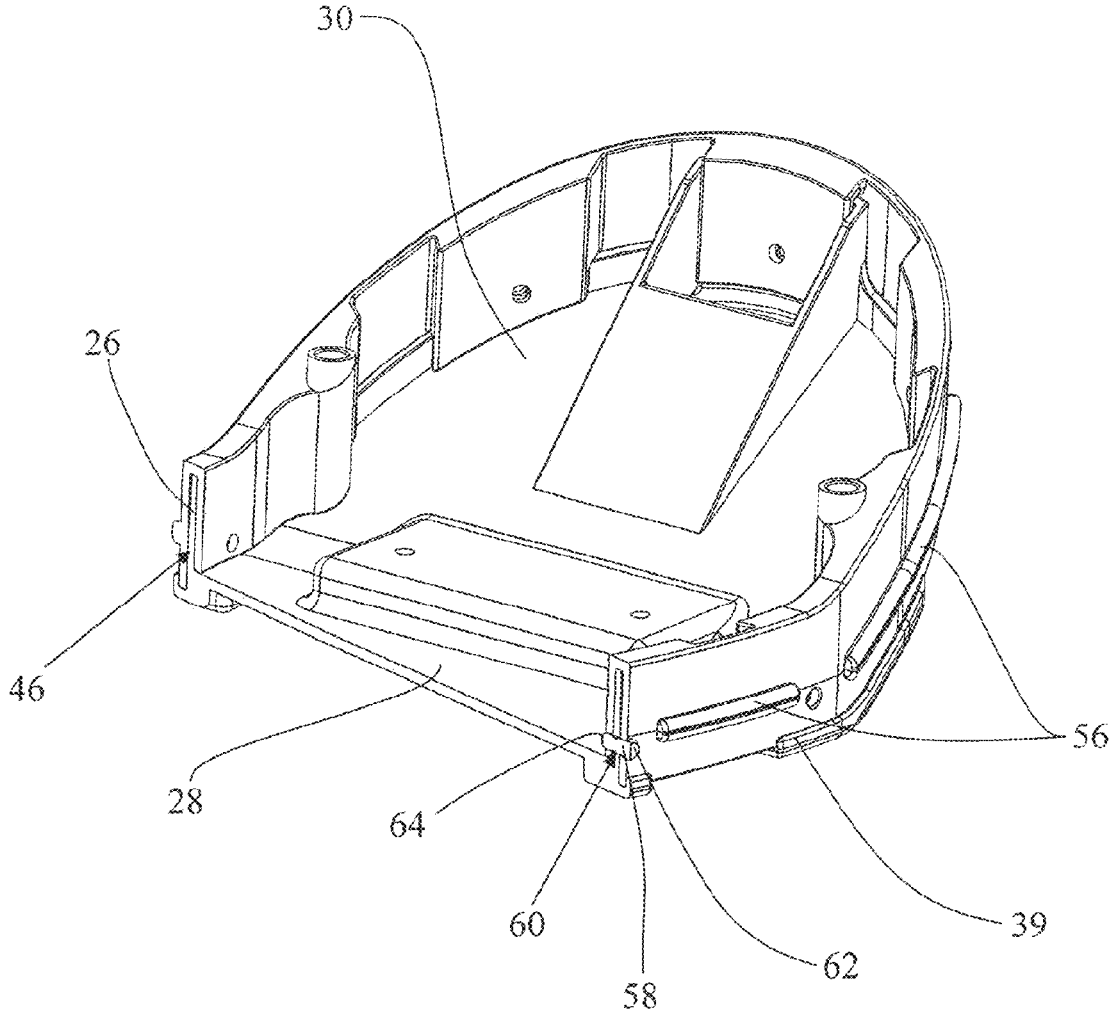
FIG. 3 is a partial sectional view of a preferred embodiment of the present invention.
Figure 4:
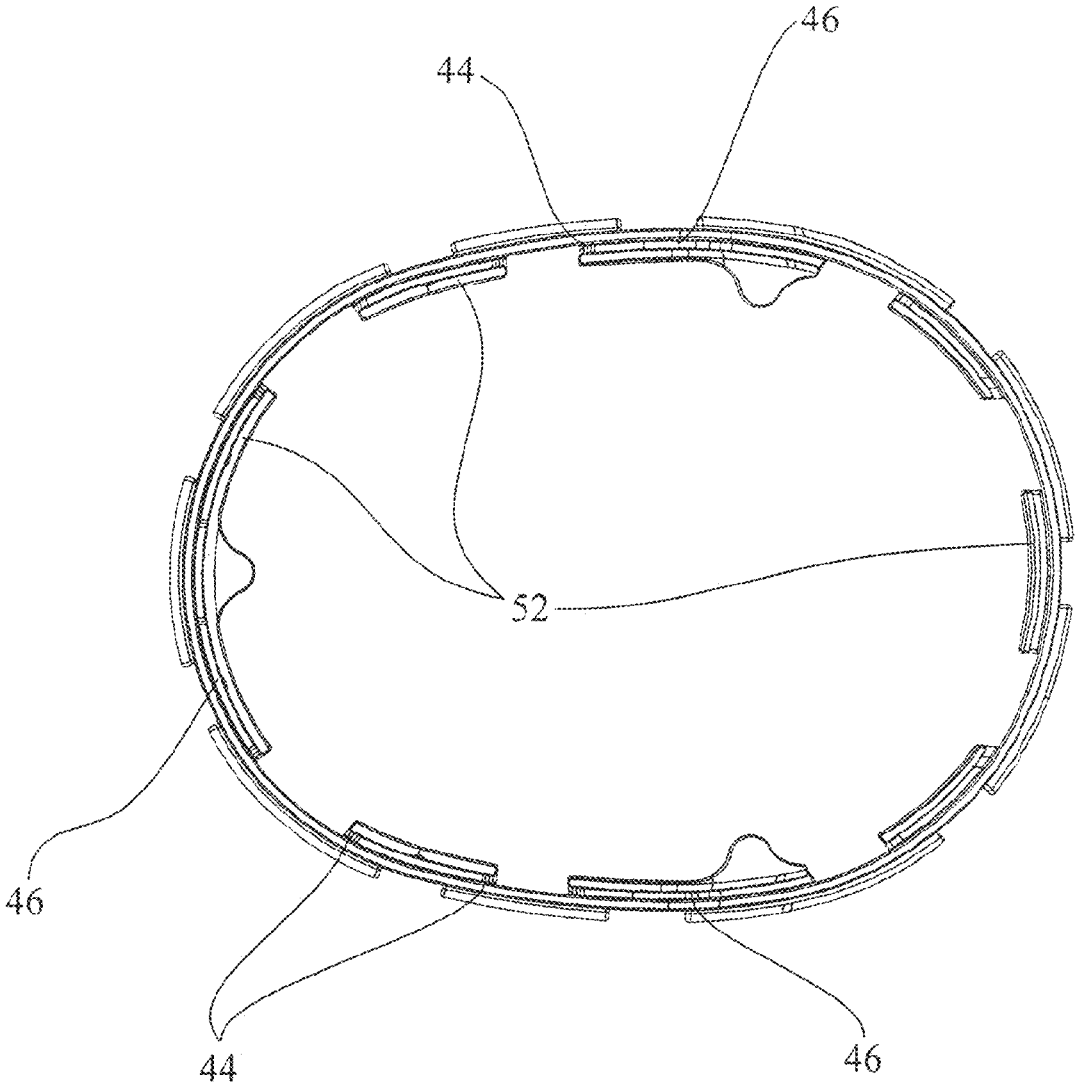
FIG. 4 is a bottom view of the upper frame of a preferred embodiment of the present invention.

Below are further detailed descriptions of the present invention by taking a preferred embodiment as an example and with the accompanying drawings:

Firstly, referring to FIG. 1 to FIG. 3 depicting a preferred embodiment of the present invention of a base for golf bag 10, the golf bag comprises a head frame, a base 10, a plurality of support rods connecting the head frame and the base, a bag body covering the outside of the head frame and the base 10, and a support frame (not shown in the drawing), wherein, the composition of the head frame, support rods, bag body and support frame are roughly the same as conventional golf bags and are therefore not detailed herein. The main feature of the present invention is that, the base 10 comprises base plate 12, an upper frame 14 and a plurality of coupling pieces 16.

The base plate 12, made of plastic materials with appropriate hardness in the shape of a shell having an upward opening, comprises a baseboard 22, a ring body 24 and a plurality of inserting plates 26. The baseboard 22 is roughly in a folded shape, having a flat plane 28 and an inclined plane 30 connected to one side of the flat plane 28. One side of the inclined plane 30 is provided with an opening 32, for the support frame of the golf bag to go through. The ring body 24 is connected to the periphery of the flat plane 28 and inclined plane 30. Each of the inserting plates 26 is roughly in the shape of a rectangle, configured on the ring body 24 in a projecting form. At positions corresponding to the inserting plates 26, a plurality of through portions 34 are respectively configured on the ring body 24. Each of the through portions 34 respectively comprises a perforation 36 and two clasping pieces 38 configured inside the perforation 36. Each of the clasping pieces 38 can flexibly bend toward each other. Moreover, the bottom edge of the baseboard 22 is further configured with a plurality of strengthening portions 39, with a roughly L-shaped section, to provide a resistance against external forces which may cause outward expansion of the ring body 24.

The upper frame 14, made of plastic materials with appropriate hardness, roughly has a ring shape complementary to sectional shape of the ring body 24. The inside of its periphery is configured with a plurality of inserting portions 40. The numbers of inserting portions 40 are the same as that of the inserting plates 26. Each comprises a plate body 42 and at least one check block 44. One end of each plate body 42 is connected to the upper frame 14, and the other end is separated from the upper frame 14 with a preset distance. In this way, an inserting slot 46 with a downward opening is formed between each plate body and the upper frame 14. A through-hole 48, 50 is configured respectively on each plate body 42 and the upper frame 14, which are connected and aligned to the inserting slots 46. The check blocks 44 are connected to one side of the plate body 42 (or both sides), so that the inserting slots 46 have a downward opening. The tip end of each plate body 42 is configured with a curved guiding surface 52. Based on this, the upper frame 14 is coupled onto the base plate 12 by corresponding each of the inserting slots 46 to the inserting plates 26. Each through-hole 48, 50 corresponds to the two clasping pieces 38 of the through portions 34. Furthermore, the preset outside of the plate body 42 (i.e., the inside of the upper frame 14) is further configured with a socket 54, roughly in the shape of a cylinder with an upward opening, for insertion of the support rods of the golf bag, and the outside of the upper frame 14 is further configured with a plurality of aligning portions 56, in the form of extending bars projecting from the surface of the upper frame 14. The bottom end of the golf bag body corresponds to the aligning portions 56.

The coupling pieces 16 are made of metal, having the same number as that of the through-holes 48, 50 and through portions 34, and are inserted between the two clasping pieces 38 of each of the through-holes 48, 50 and through portions 34 in a detachable form. Each comprises a rod body 58, and each rod body 58 is configured with a clasping groove 60 in a circular form, with its two ends respectively configured with a checking block 62 and an inserting tip 64. Each of the clasping grooves 60 is used to avoid falloff when the coupling pieces 16 are inserted into the through-holes 48, 50 and through portions 34 through the clasping of the two clasping pieces 38. Each checking block 62 projects from the rod body 58 and can resist against the outer rim of the through-hole 50, so as to prevent water or sands from entering the base 10 via each through-hole 48, 50 and through portion 34. Each inserting tip 64 is roughly in the shape of a cone, slightly projecting from each through-hole 48 and corresponds to the inside of the base plate 12.

Based on this, the present invention of a base for golf bag 10 has the following features and efficacies:

When coupling the base plate 12 with the upper frame 14, the arc-shaped guiding surface 52 at the end of each plate body 42 can guide the inserting plates 26 to easily insert into the inserting slots 46, making assembly very easy. And after each inserting plate 26 is inserted into the inserting slots 46, it will not move to and fro (or rotate) inside the inserting slots 46 due to the restriction of its shape and limit by each check block 44, so that each coupling piece 16 can go through and be clasped inside each through-hole 48, 50 and through portion 34. Therefore, the base plate 12 and the upper frame 14 can be rigidly coupled together.

In addition, as each coupling piece 16 is inserted inside each through-hole 48, 50 and through portion 34 in a detachable form, when the base plate 12 or upper frame 14 are slightly worn out after a long time of usage, or when the user wants to replace them, the user can easily detach each of the coupling pieces 16 by applying a slight force to push the inserting tip 64 of each of the coupling pieces 16. Then, after replacing the preset base plate 12 or upper frame 14, the base plate 12 and upper frame 14 can be coupled together again by inserting each of the coupling pieces 16, so that the assembly of the base 10 can be easily completed. Such a convenient manner of assembly and disassembly can fully meet the needs of personalization and enhance the usage flexibility of the golf bag.

Moreover, as the base plate 12 uses inserting plates 26 in the form of thin plates to insert into the inserting slots 46, it can save production materials, resulting in light weight, more convenient assembly by the users and lowered transportation costs.

From the above, it is known that the present invention of a base for golf bag is combined through insertion into each other of a base plate and an upper frame in a detachable form, and such a structure not only facilitates replacements according to individual needs of the users for personalization, but also enhances the flexibility of usage of the golf bag; in addition, through insertion between each of the inserting plates and inserting slots, the coupling pieces are fixed inside the through-holes and through portions. Such a structure avoids relative rotation and separation of the base plate and upper frame, and moreover can save the production material for the base, fulfilling such efficacies as light weight, easy production and assembly, as well as lowered transportation costs.

What is claimed is:

1. A base for golf bag, connected to the bottom end of the golf bag, comprising:

a base plate, roughly in the shape of a shell with an upward opening, including a baseboard and a ring body; the baseboard comprises a flat plane and an inclined plane connected to one side of the flat plane; one side of the inclined plane is provided with an opening, for the support frame of the golf bag to go through; the ring body is connected to the periphery of the flat plane and inclined plane; the ring body is configured with a number of inserting plates in a projecting form; at positions corresponding to the inserting plates, a number of through portions are respectively configured on the ring body;

an upper frame, complementary to the sectional shape of the ring body, coupled on the ring body in a detachable form, with its periphery configured with a number of inserting slots with downward opening and through-holes connecting with the inserting slots; the inserting plates are correspondingly inserted into the inserting slots, so that the base plate and upper frame can be coupled together; the through-holes correspond with the through portions; and a plurality of coupling pieces, inserted into the through-holes and through portions in a detachable form.

2. The structure defined in claim 1, wherein the bottom edge of the baseboard is further configured with a plurality of strengthening portions, to provide a resistance against external forces which may cause outward expansion of the ring body.

3. The structure defined in claim 1, wherein each of the through portions comprises a perforation and two clasping pieces configured inside the perforation in a form that they can flexibly bend toward each other; each coupling piece is configured with a clasping groove, used to avoid falloff when the coupling pieces are inserted into the through-holes and through portions through the restriction occurred when the two clasping pieces click into the clasping groove.

4. The structure defined in claim 1, wherein the inside of the upper frame is configured with a number of plate bodies in a projecting form; one end of the plate body is connected to the upper frame, and the other end is separated from the upper frame with a preset distance; in this way, an inserting slot is formed between each plate body and the upper frame; a through-hole is configured respectively on each plate body and the upper frame, which are aligned to the through portions.

5. The structure defined in claim 4, wherein a number of check blocks are connected between the plate body and the upper frame.

6. The structure defined in claim 4, wherein the preset outside of the plate body is further configured with a number of sockets, for insertion of the support rods of the golf bag.

7. The structure defined in claim 4, wherein the tip end of the plate body is configured with a guiding surface, to help the inserting plate inserting into the corresponding inserting slot.

8. The structure defined in claim 4, wherein the outside of the upper frame is further configured with a number of aligning portions; the aligning portions correspond to the upper rim of the through-hole; the bottom end of the golf bag body corresponds to the aligning portions.

9. The structure defined in claim 8, wherein the aligning portion is roughly in the form of extending bars projecting from the surface of the upper frame.

10. The structure defined in claim 3, wherein the coupling piece comprises a rod body, and the clasping groove is configured on the rod body in a circular form; the two ends of the rod body are respectively configured with a checking block and an inserting tip; the checking block is projected from the rod body and can resist against the outer rim of the through-hole; the inserting tip is roughly in the shape of a cone, slightly projecting from each through-hole and corresponds to the inside of the base plate.

* * * * *